US006422297B2

(12) United States Patent
Salata

(10) Patent No.: US 6,422,297 B2
(45) Date of Patent: Jul. 23, 2002

(54) INTERCHANGEABLE DIE FOR A DIE CASTING MACHINE

(76) Inventor: Zoltan P. Salata, 7616 Florence Ave., Downers Grove, IL (US) 60516

( * ) Notice: Subject to any disclaimer, the term of this patent is extended or adjusted under 35 U.S.C. 154(b) by 0 days.

(21) Appl. No.: 09/808,444

(22) Filed: Mar. 14, 2001

Related U.S. Application Data

(60) Provisional application No. 60/189,590, filed on Mar. 15, 2000.

(51) Int. Cl.[7] ..... B22D 17/10; B22D 17/26

(52) U.S. Cl. ..... 164/312; 164/342

(58) Field of Search ..... 164/137, 339, 164/341, 342, 113, 312

(56) References Cited

U.S. PATENT DOCUMENTS

| | | | | |
|---|---|---|---|---|
| 3,733,161 | A | 5/1973 | Nussbaum | 425/243 |
| 4,009,979 | A | 3/1977 | Martin | 425/107 |
| 4,158,910 | A | 6/1979 | Hanas et al. | 29/469 |
| 4,202,522 | A | 5/1980 | Hanas et al. | 249/102 |
| 4,348,165 | A | 9/1982 | Vostrovsky | 425/185 |
| 4,416,604 | A | 11/1983 | Bender et al. | 425/183 |
| 4,472,127 | A | 9/1984 | Cyriax et al. | 425/183 |
| 4,500,274 | A | 2/1985 | Cyriax et al. | 425/185 |
| 4,500,275 | A | 2/1985 | Ruhl | 425/192 R |
| 4,714,421 | A | 12/1987 | D'Agostino | 425/192 R |
| 4,776,783 | A | 10/1988 | Pelle et al. | 425/190 |
| 4,786,244 | A | 11/1988 | Holzschuh | 425/192 R |
| 4,793,785 | A | 12/1988 | Osada | 425/116 |
| 4,805,285 | A | 2/1989 | Reyes | 29/407 |
| 4,861,254 | A | 8/1989 | Takeuchi et al. | 425/190 |
| 4,867,668 | A | 9/1989 | Miyairi | 425/192 |
| 4,872,827 | A | 10/1989 | Noda | 425/526 |
| 4,888,252 | A | 12/1989 | Kilim | 428/582 |
| 4,929,166 | A | 5/1990 | DiSimone et al. | 425/190 |
| 5,012,568 | A | 5/1991 | DiSimone et al. | 29/402.08 |
| 5,022,784 | A | 6/1991 | DeVries et al. | 405/15 |
| 5,033,784 | A | 7/1991 | Martin | 294/91 |
| 5,096,404 | A | 3/1992 | Janos et al. | 425/190 |
| 5,350,289 | A | 9/1994 | Martin | 425/190 |
| 5,562,935 | A | 10/1996 | Martin | 425/552 |

FOREIGN PATENT DOCUMENTS

| | | |
|---|---|---|
| JP | 176346 | 2/1987 |
| JP | 240050 | 5/1987 |

OTHER PUBLICATIONS

Drawings, "Moule Plastique Pour Exposition". 7 pages, Apr. 24, 1997.

Adverstisement, Die Casting Engineering, 1 page, Sep., 2001.

*Primary Examiner*—Kuang Y. Lin
(74) *Attorney, Agent, or Firm*—Marshall, Gerstein & Borun

(57) ABSTRACT

An interchangeable die system in accordance with the present invention may include two main parts: a shank and a die assembly. The shank is a structural frame that is secured to and remains attached to the die casting machine during a change of the die assembly. The die assembly consists of a die, an adaptor plate and an ejector plate assembly. The die assembly is secured to the shank using the adaptor plate and a locking cam. A spool assembly slides within the shank to actuate the ejector plate assembly.

10 Claims, 11 Drawing Sheets

INTERCHANGEABLE DIE FOR A DIE CASTING MACHINE

CROSS-REFERENCE TO RELATED APPLICATION

This application claims priority to United States provisional patent application Ser. No. 60/189,590, entitled "Interchangeable Die for a Die Casting Machine and Method," filed Mar. 15, 2000, the disclosure of which is hereby expressly incorporated herein by reference.

BACKGROUND OF THE INVENTION

1. Field of the Invention

The invention relates generally to die casting, and more particularly, the invention relates to interchangeable dies for a die casting machine.

2. Description of the Related Art

An injection molding machine or die casting machine operates at a high speed to produce hundreds of die cast products per hour. Between the production of two different die cast products, the die for forming one part must be removed from the die casting machine and a new die must be inserted into the casting machine to form the new part. Because each die casting machine is a complex mechanical assembly including such parts as lock-out pins, ejector pins, slides, pulls, coolant lines and removable dies or molds to create the desired shapes, it is labor intensive and time consuming to disassemble the machine to change the die. Typically, each die has accessory components such as those previously mentioned that must be detached, reattached and/or appropriately adjusted to accommodate each new die. In addition, a die consists of two or more portions that when closed together define a cavity into which the die cast material, such as zinc, is injected. Each die portion is typically coupled to a shank that serves as a structural frame and connects the die portion to a toggle mechanism of the die casting machine. Because the die portion is secured to the shank, typically by machine screws that extend longitudinally through the shank and engage a rear surface of the die portion, the shank and die portion must be removed together from the die casting machine when changing dies. With current die casting machines and die designs, skilled technicians may spend hours disassembling the machine to remove and reinsert a new die.

As can be appreciated from the foregoing discussion, changing a die in current die casting machines is very time-consuming and may often take as long as several hours. While the dies are changed, the machine recalibrated and the accessories reconnected to conform to a new die, the machine sits idle wasting valuable production time. This idle time is undesirable because it affects the profitability of the machine, e.g. a long downtime to change dies means less parts are produced and thus less profit to the company. So, to maximize the productivity of each die casting machine, the time required to change the die must be reduced. With such a reduction in change time, consumers will benefit because manufacturing costs will decrease and ultimately be passed to the consumer in the form of less expensive products in the stores.

There have been attempts to increase the speed at which dies are changed. In U.S. Pat. No. 5,350,289, a quick change system is disclosed that has a mold base including an ear plate for attachment to the back half of the mold base and an adaptor frame including a pair of U-shaped guide channels for receiving and supporting the ear plate. T-shaped guide rollers are mounted in line with each side of the guide channel to capture the ear plate and keep the ear plate in line with the adaptor frame. While the guide rails and corresponding rollers ease the transferability of the molds, the addition of parts makes the fabrication of the machine assembly more complex and may, therefore, increase manufacturing costs.

In U.S. Pat. No. 5,562,935, an injection molding machine having a multi-port apparatus for connecting multiple coolant lines to a mold during installation is disclosed. While such an apparatus and its corresponding coolant lines may decrease the amount of time required to change the mold base, the multi-port apparatus also increases the complexity of the injection molding machine and may, therefore, complicate die changing and thereby increase manufacturing costs.

Thus, there is a need for an interchangeable die for a die casting machine and a method for changing dies in a die casting machine that reduces the time and labor required to make a die change.

SUMMARY OF THE INVENTION

In accordance with a preferred embodiment of the invention, a "Quick-Change" die provides an interchangeable die that allows the die or die assembly including the die and its corresponding attachments to be removed from the die casting machine independent of the shank which remains coupled to the casting machine. The interchangeable die construction greatly reduces the amount of time skilled technicians must spend changing dies and overcomes other disadvantages associated with the prior art by eliminating the necessity to disassemble other portions of the die casting machine not directly related to the die itself, such as sensors, coolant lines, mechanical connectors and the like, that are attached to the shank.

In accordance with a further preferred embodiment of the invention, a method, in conjunction with an interchangeable die design, is provided for facilitating the insertion and removal of various dies from a die casting machine.

An interchangeable die system in accordance with the present invention may include two main parts: a shank and a die assembly. The shank is a structural frame that is secured to and remains attached to the die casting machine during a change of the die. The die assembly consists of a die, an adaptor plate and an ejector plate. The die assembly is secured to the shank using the adaptor plate and a locking cam. A spool assembly slides within the shank to actuate the ejector plate assembly. The ejector plate assembly, located within the cavity of the shank, is engaged by the assembly.

BRIEF DESCRIPTION OF THE DRAWINGS

The many advantages and features of the present invention will be appreciated from the following detailed description of several preferred embodiments with reference to the attached drawings wherein like reference numerals are used to represent like elements, and in which.

DETAILED DESCRIPTION OF THE PREFERRED EMBODIMENTS

Figure 1:
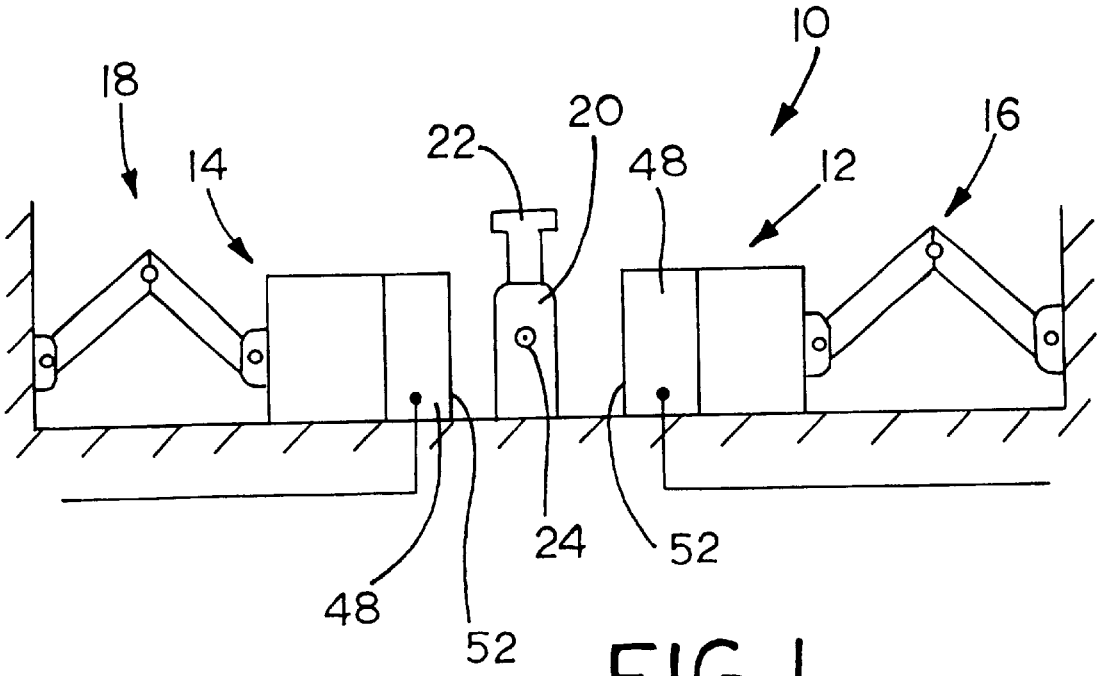
FIG. 1 is a schematic illustration of a die casting machine adapted in accordance with a preferred embodiment of the present invention.

Referring to FIG. 1, there is illustrated schematically a die casting machine 10. The die casting machine 10 includes interchangeable die systems 12 and 14 coupled to corresponding toggle mechanisms 16 and 18 of the die casting machine 10. The toggle mechanisms 16 and 18 operate in conjunction with one or more prime mover (not depicted) as is well known in the art for relatively translating the interchangeable die systems 12 and 14 for forming a mold chamber (not depicted). The die casting machine 10 includes a source of raw material, such as molten zinc, coupled to a gooseneck 20. The gooseneck 20 is coupled to introduce the raw material into the closed die systems 12 and 14, and a plunger 22, operates within the gooseneck 20 to communicate the raw material under pressure into the mold chamber. The raw material is ejected from the gooseneck 20 into the mold chamber through a nozzle 24.

Figure 2:
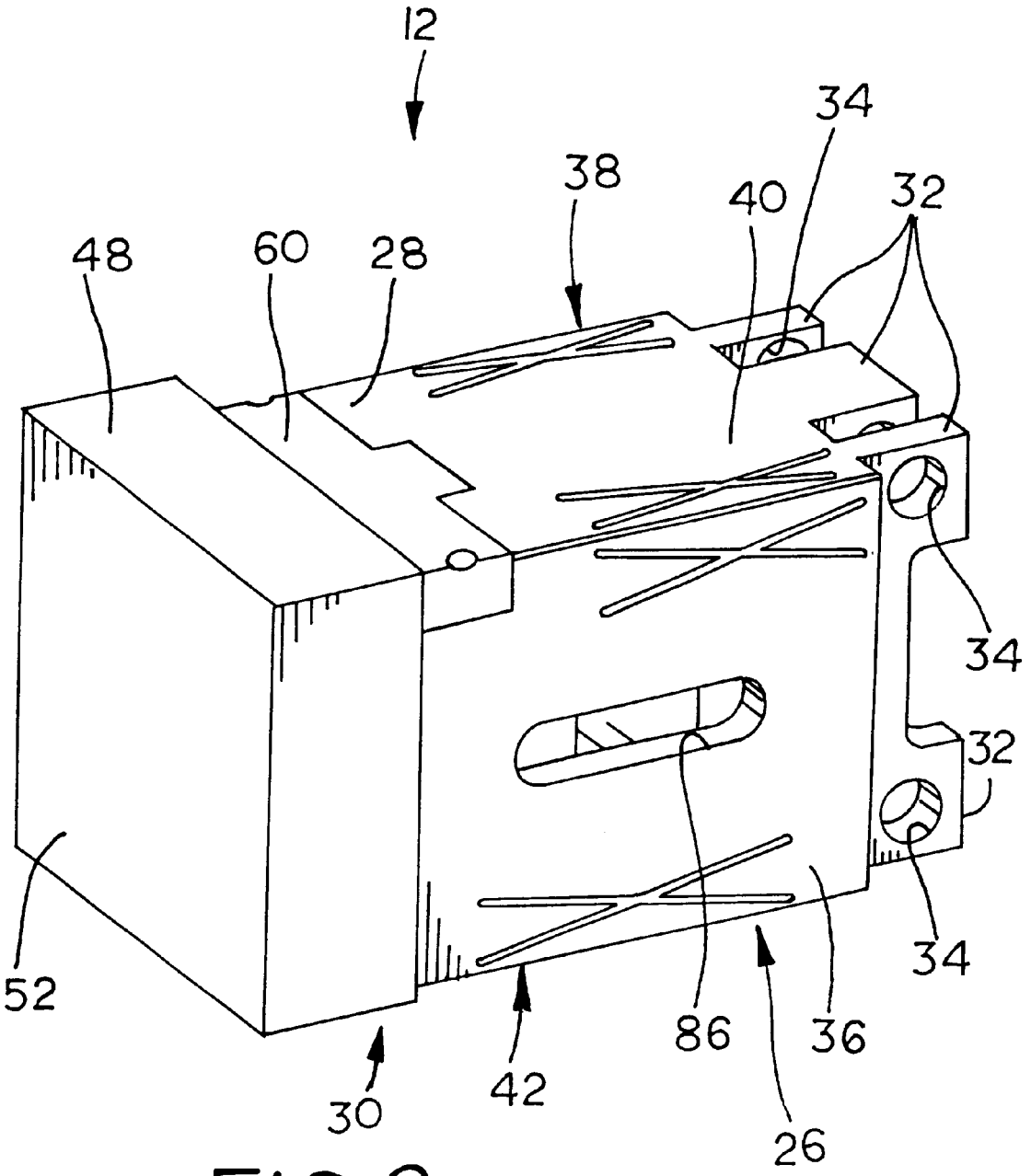
FIG. 2 is a perspective view of a die assembly in accordance with a preferred embodiment of the present invention.

Referring to FIG. 2, each "Quick-Change" or interchangeable die system 12 and 14 in accordance with a preferred embodiment of the invention includes a shank 26 and a die assembly 30. At least two and as many as six interchangeable die systems can be secured to a die casting machine for casting a part. The shank 26 includes a rectangular, structural frame 28 that is secured to and remains attached to the toggle mechanisms 16 and 18 of the die casting machine 10 during the die change. In this regard, the shank 26 includes flanges 32 formed with attachment apertures 34 through which compression nuts and spacers are used to pivotally connect the shank 26 with compression lever brackets of the toggle mechanisms 16 and 18.

Figure 3:
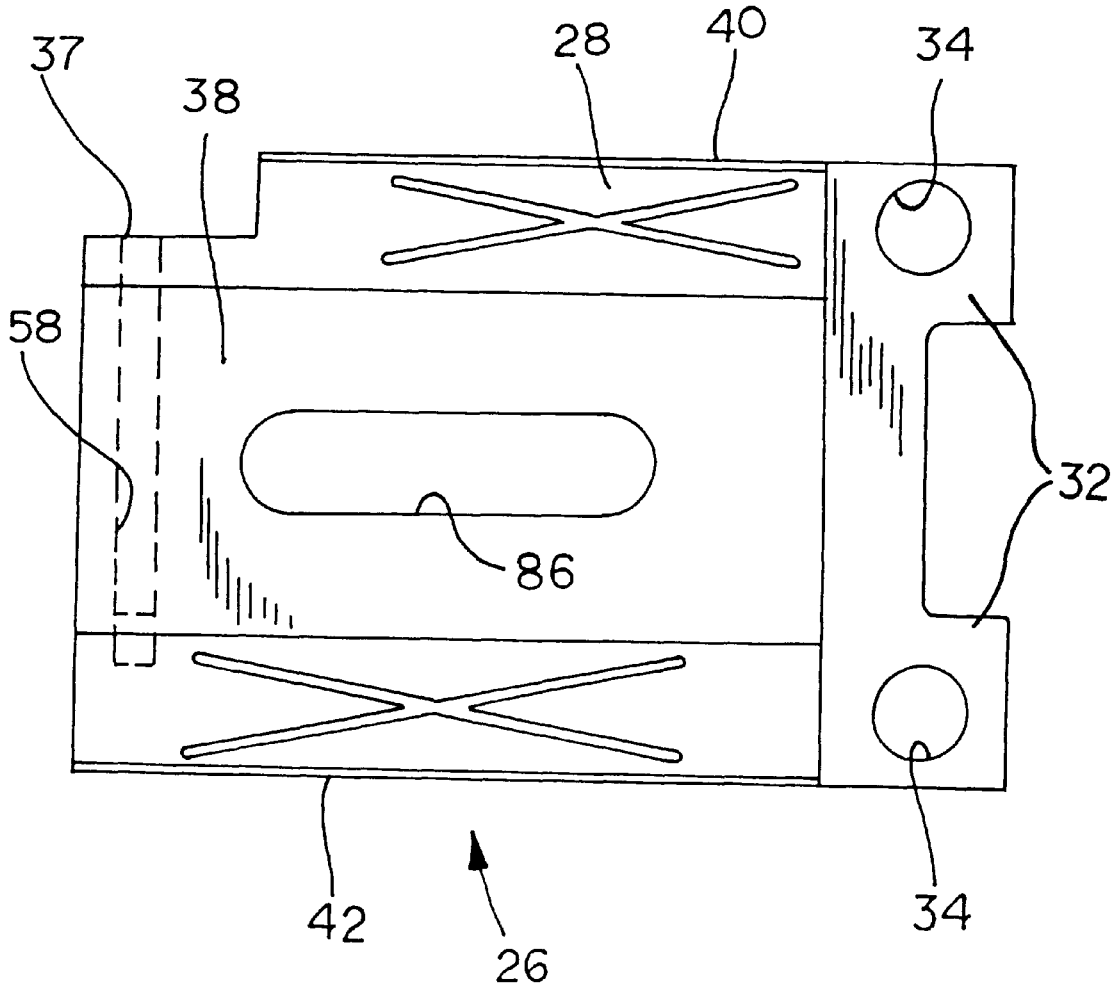
FIG. 3 is a front elevation view of a shank adapted in accordance with a preferred embodiment of the invention.
Figure 4:
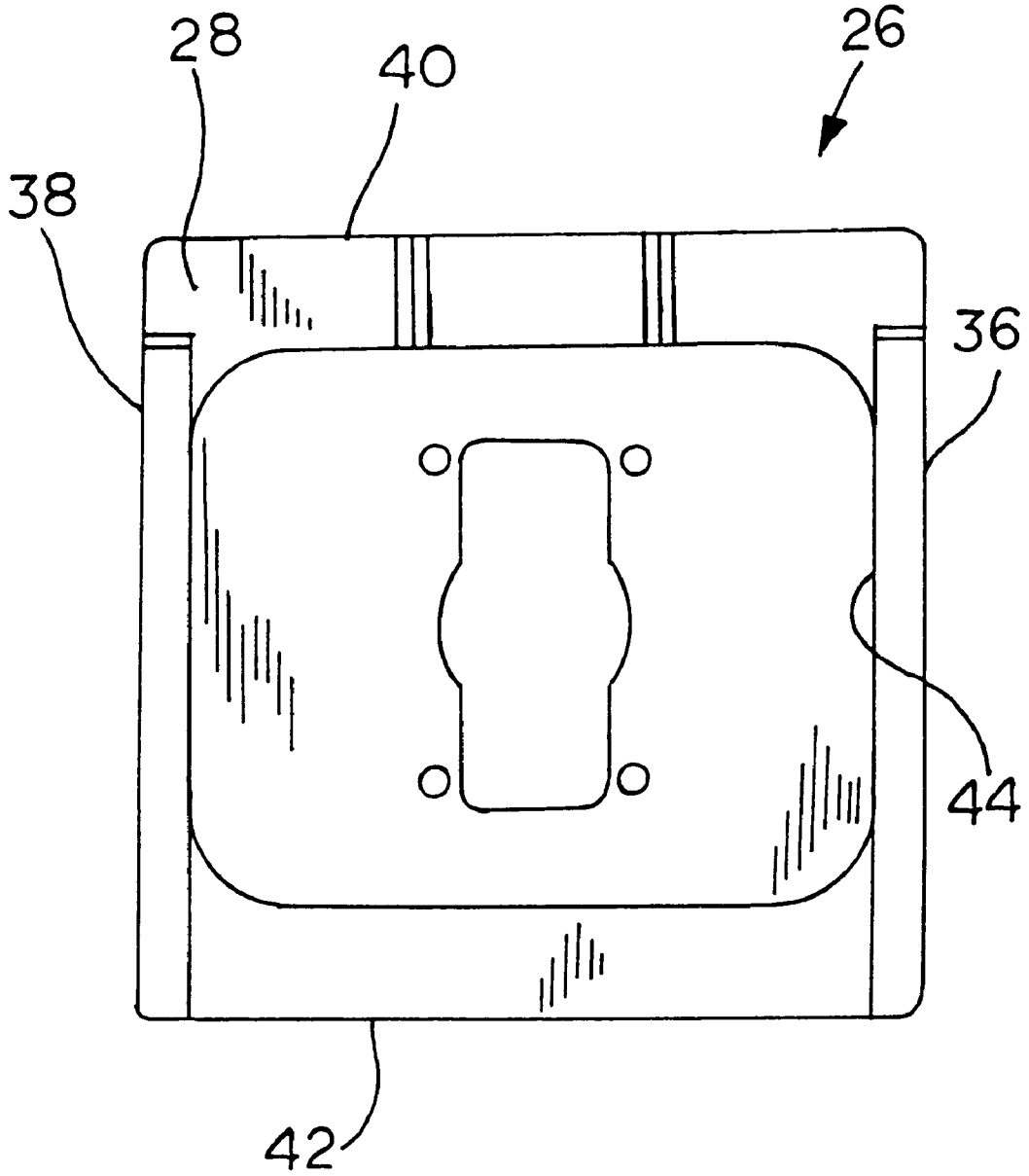
FIG. 4 is a side view of the shank illustrated in FIG. 3.

With continued reference to FIG. 2 and reference also to FIGS. 3 and 4, the structural frame 28 has a front face 36, rear face 38, top face 40 and bottom face 42 forming a cavity 44 in which the die assembly 30 and a spool assembly 46 are positioned. Otherwise, the shank 26 is of conventional construction. The front face 36 and the rear face 38 may be used interchangeably depending on the orientation of the die assembly 30 in the die casting machine 10. It should be appreciated that in alternate embodiments of the invention the shank may take other shapes, which permit the shank 26 to remain coupled to the toggle mechanisms 16 and 18 of the die casting machine 10 throughout the die changing operation.

Figure 5:
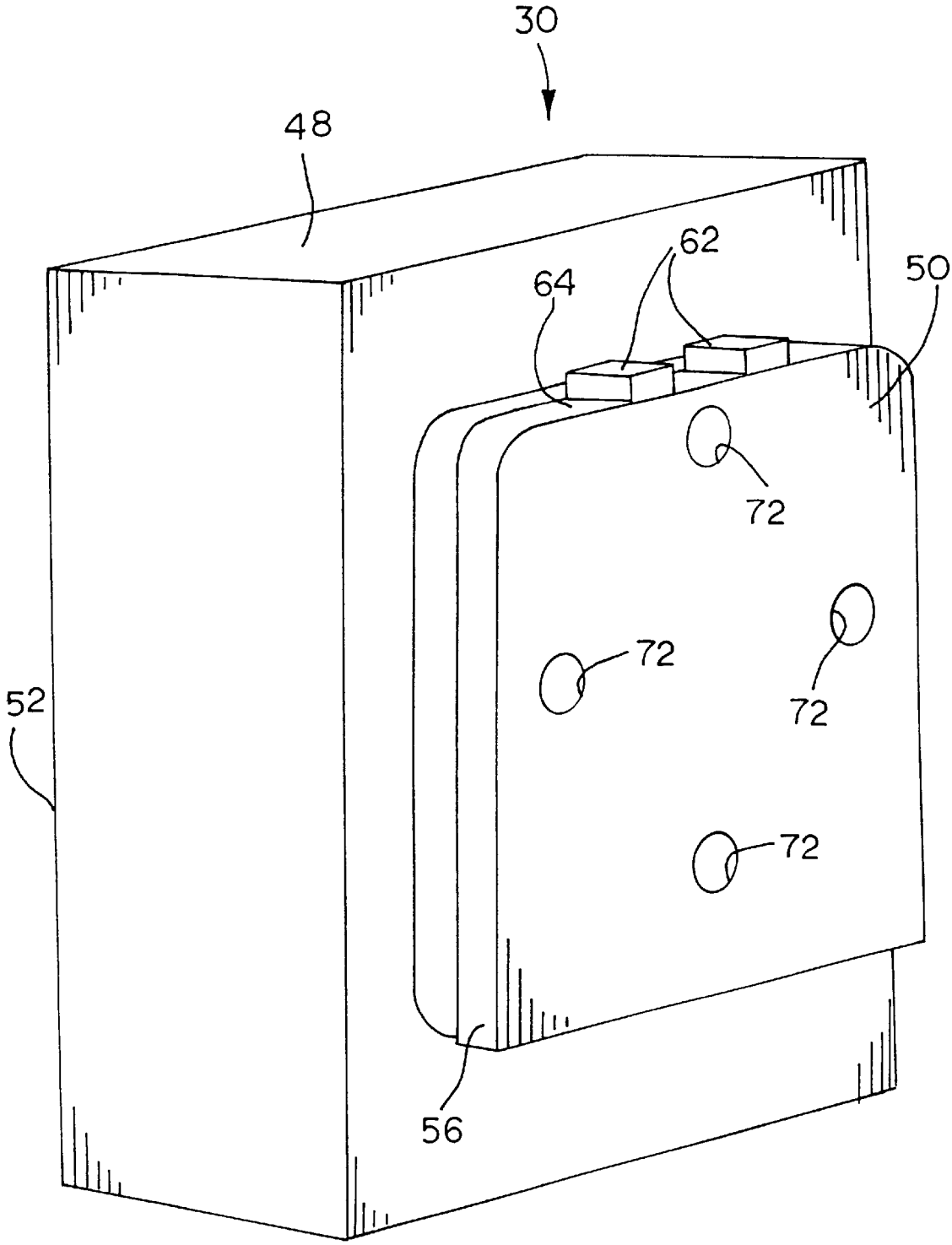
FIG. 5 is perspective view of a die assembly in accordance with a preferred embodiment of the present invention.
Figure 6:
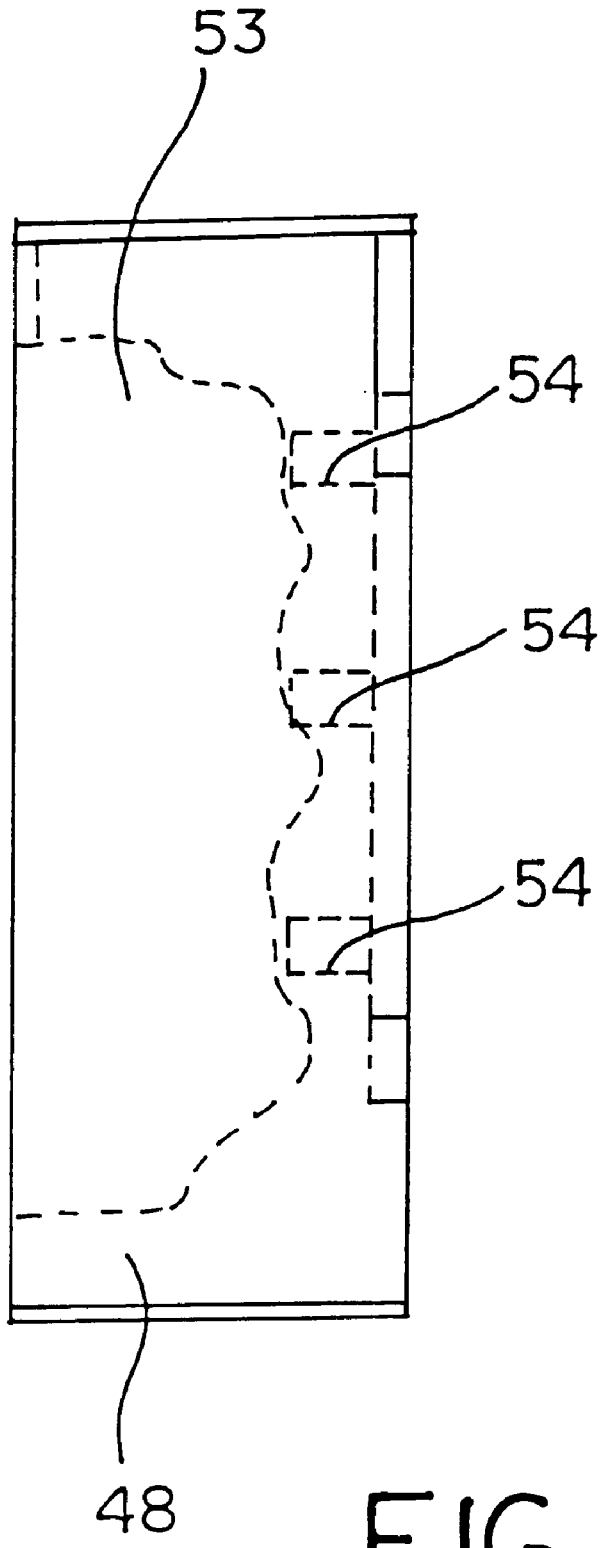
FIG. 6 is a front elevation view of a die in accordance with a preferred embodiment of the present invention.

As shown in FIG. 1 and FIG. 5, each die assembly 30 includes a die member 48 to which there is secured an adaptor plate 50. Each die member 48 includes a die face 52 into which is formed a mold portion 53 to produce one or more precision zinc injection products. As depicted in FIG. 6, the mold portion 53 is represented by the phantom line. When the mold portion 53 of each die 48 in the machine 10 is brought together by the toggle mechanisms 16 and 18 of the die casting machine 10, the mold portions form a complete mold defining the shape of the die cast product being manufactured as well as the associated sprues, vents and the like, as is well known in the art. As described above, the mold chamber is filled with raw material, such as molten zinc metal, to produce the die cast product. During the manufacturing process, the die is cooled by a water based fluid which circulates through the die 48 as is well known.

In accordance with the preferred embodiments of the invention, the die assembly 30 is interchangeable, that is, it may be removed from the die casting machine 10 independent of the shank 26, which remains coupled to the die casting machine 10. With continued reference to FIG. 5, as described, an adaptor plate 50 is secured to the die 48, for example, by the engagement of threaded fasteners (not shown) with blind threaded apertures (not shown) formed in the die 48.

Figure 8:
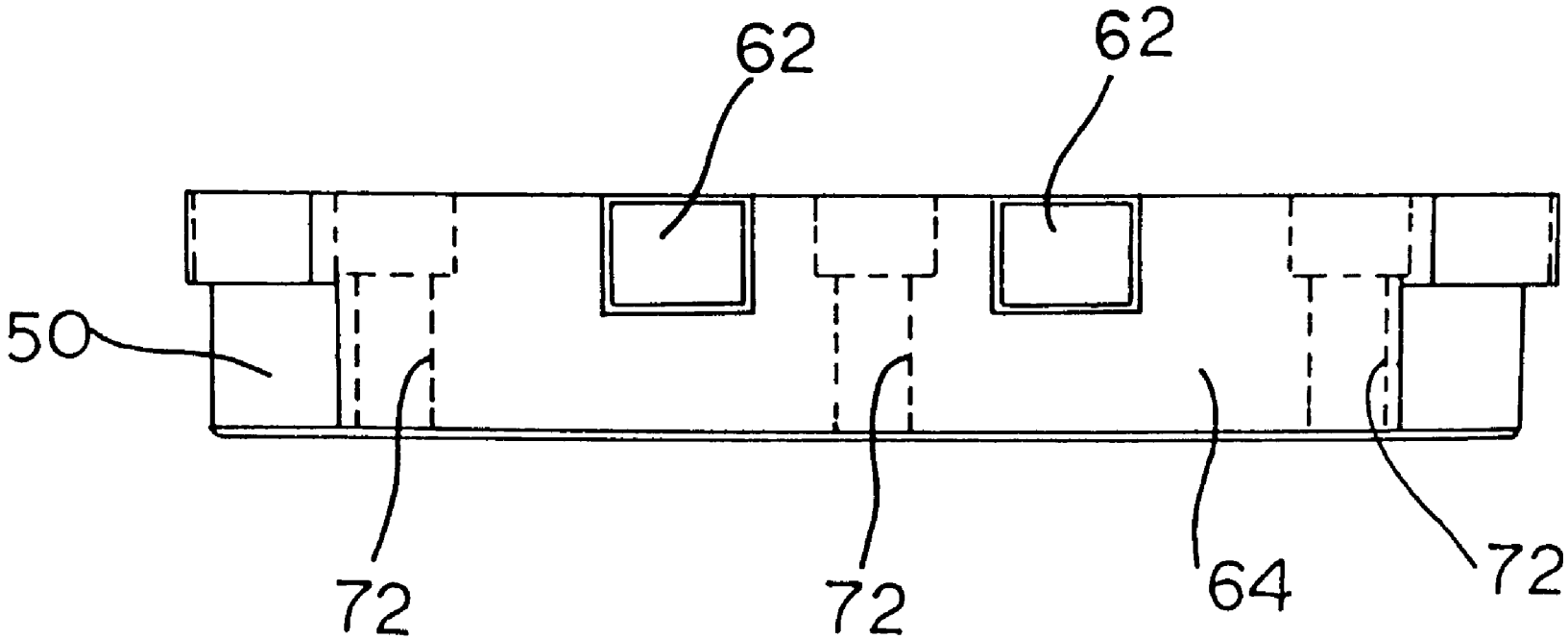
FIG. 8 is a top plan view of the adaptor plate in accordance with a preferred embodiment of the present invention.

The adaptor plate 50 includes flanged extensions 56 that engage slotted channels 58 formed within the cavity 44 of the shank 26 (FIG. 3). The engagement of the extensions 56 into the channels 58 securely engage the die assembly 30 with the shank 26. To secure the die assembly 30 to the shank 26, a cam plate 60 is secured using threaded fasteners in a relief 37 formed in the front face 36 of the shank 26 (FIG. 2). As will be appreciated, the die assembly 30 may be removed simply be sliding it relative to the shank 26. As can be seen in FIGS. 5 and 8, the adaptor plate 50 is formed with a pair of bosses 62 extending from a top surface 64 thereof. When secured to the shank 26 with the die assembly 30 positioned within the shank 26, the cam plate 60 bears against the bosses 62 to ensure that the die assembly 30 is securely retained within the shank 26.

Figure 7:
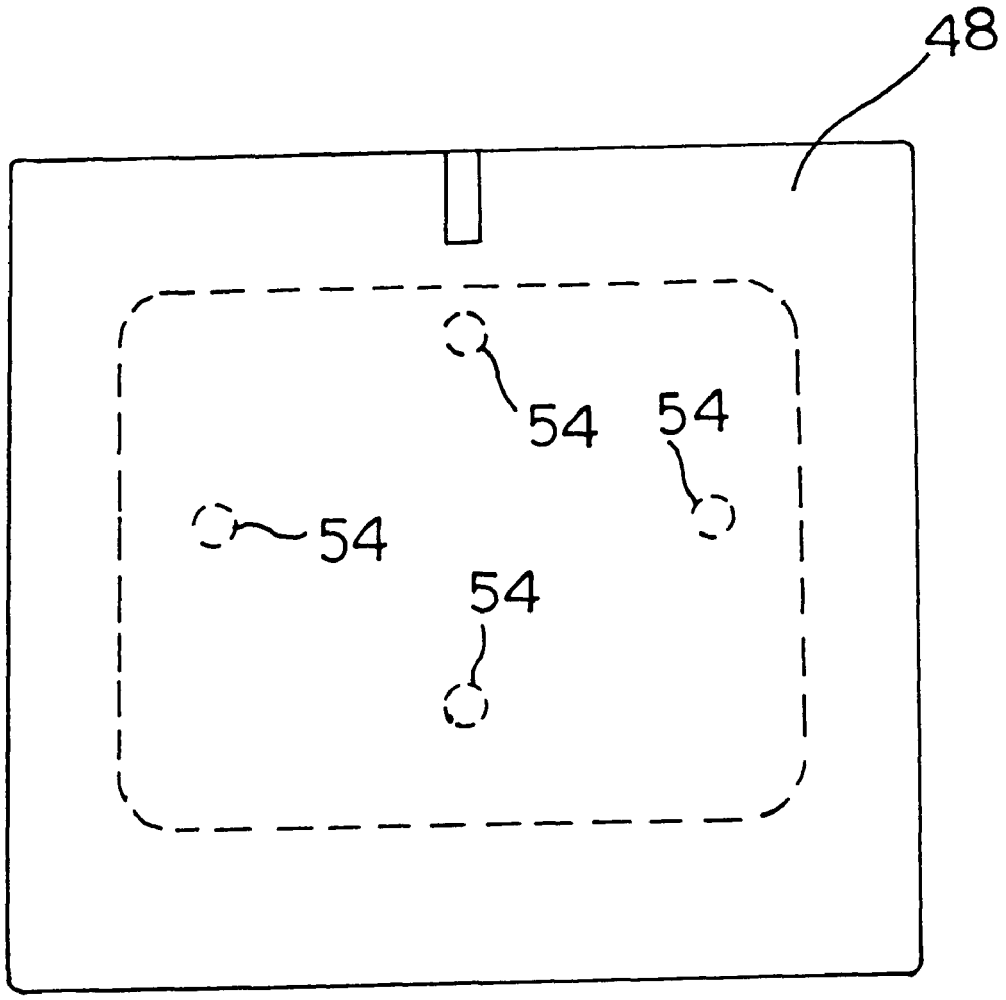
FIG. 7 is a side view of the die shown in FIG. 6.
Figure 9:
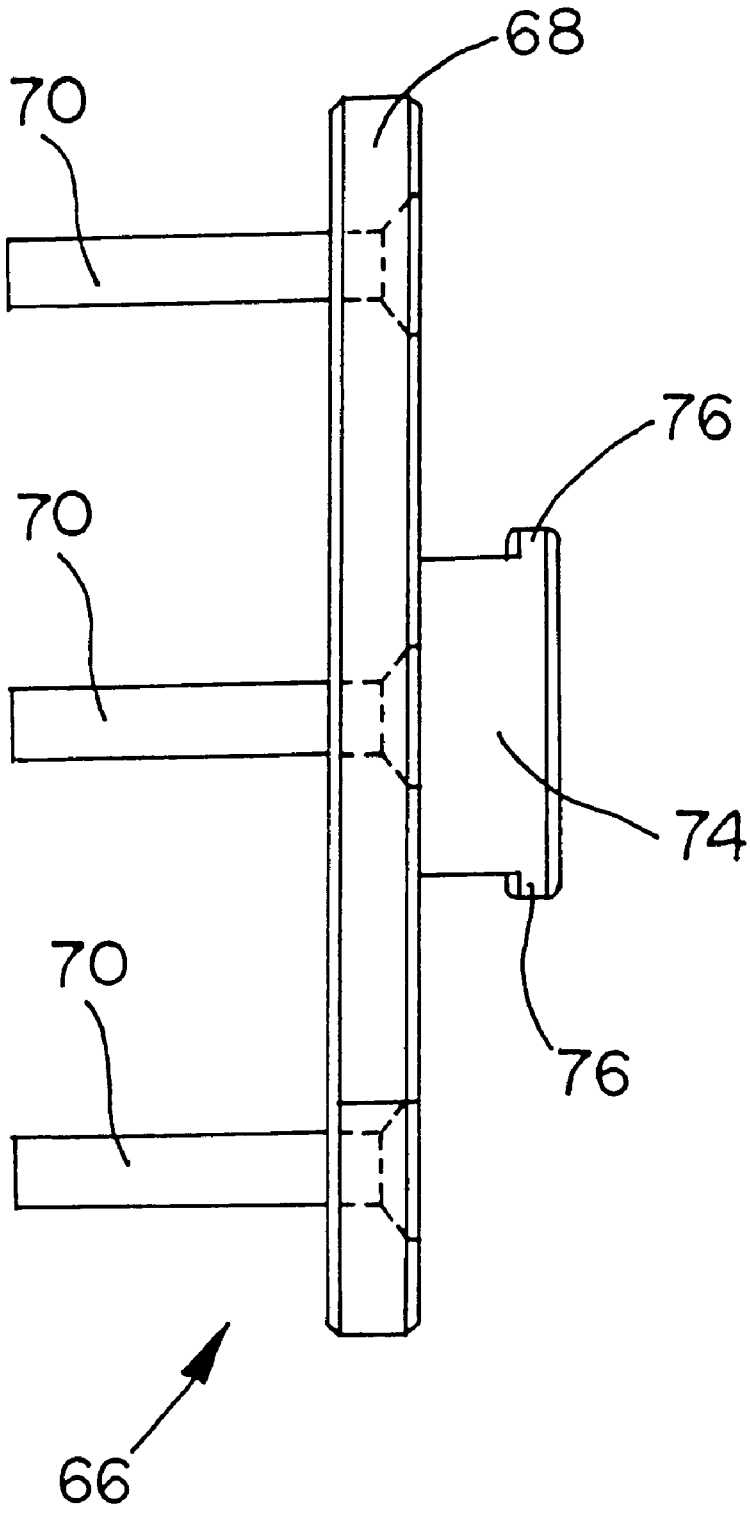
FIG. 9 is a front view of an ejector plate assembly in accordance with a preferred embodiment of the invention.
Figure 10:
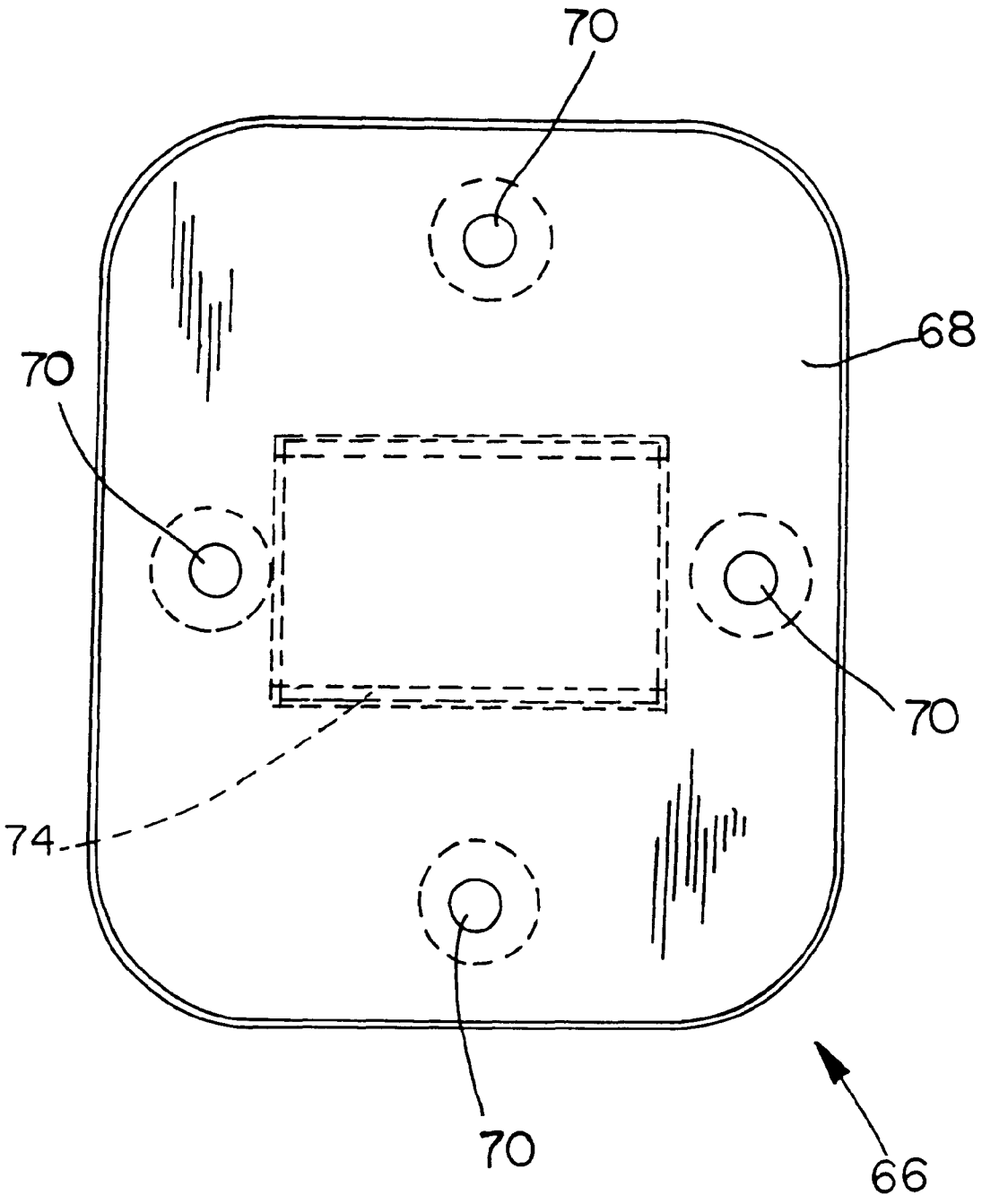
FIG. 10 is a side view of the ejector plate assembly illustrated in FIG. 9.

When a part is formed, it is necessary to eject the formed part from the die member 48. This is accomplished by providing ejector pins that extend through apertures 54 formed in the die 50 and into the mold portion 53. In accordance with the preferred embodiments of the invention, and with reference to FIGS. 9–10, the die assembly 30 further includes an ejector plate assembly 66. The ejector plate assembly 66 includes a ejector plate base 68 into which are secured a plurality of ejector pins 70, extending substantially perpendicularly from the ejector plate base 68. When the ejector plate assembly 66 is coupled with the die assembly 30, the ejector pins 70 slidingly extend through apertures 72 (FIG. 8) formed in the adaptor plate 50 and apertures 54 (FIGS. 6 and 7) formed in the die 48. As will be described, when the various die assemblies 30 of the die casting machine are brought together during operation to form a complete mold, the ejector pins 70 are withdrawn from the mold portion 53. Then, when the die assemblies 30 are separated after a die cast has been formed, the ejector pins 70 are inserted into the die 48 and extend into the mold portion 53 to eject the molded die cast from the die 48. A hub 74 extends from the ejector plate base 68 opposite the ejector pins 70. The hub 74 has two opposing flanges 76 for engaging the spool 46. (FIG. 11)

Figure 11:
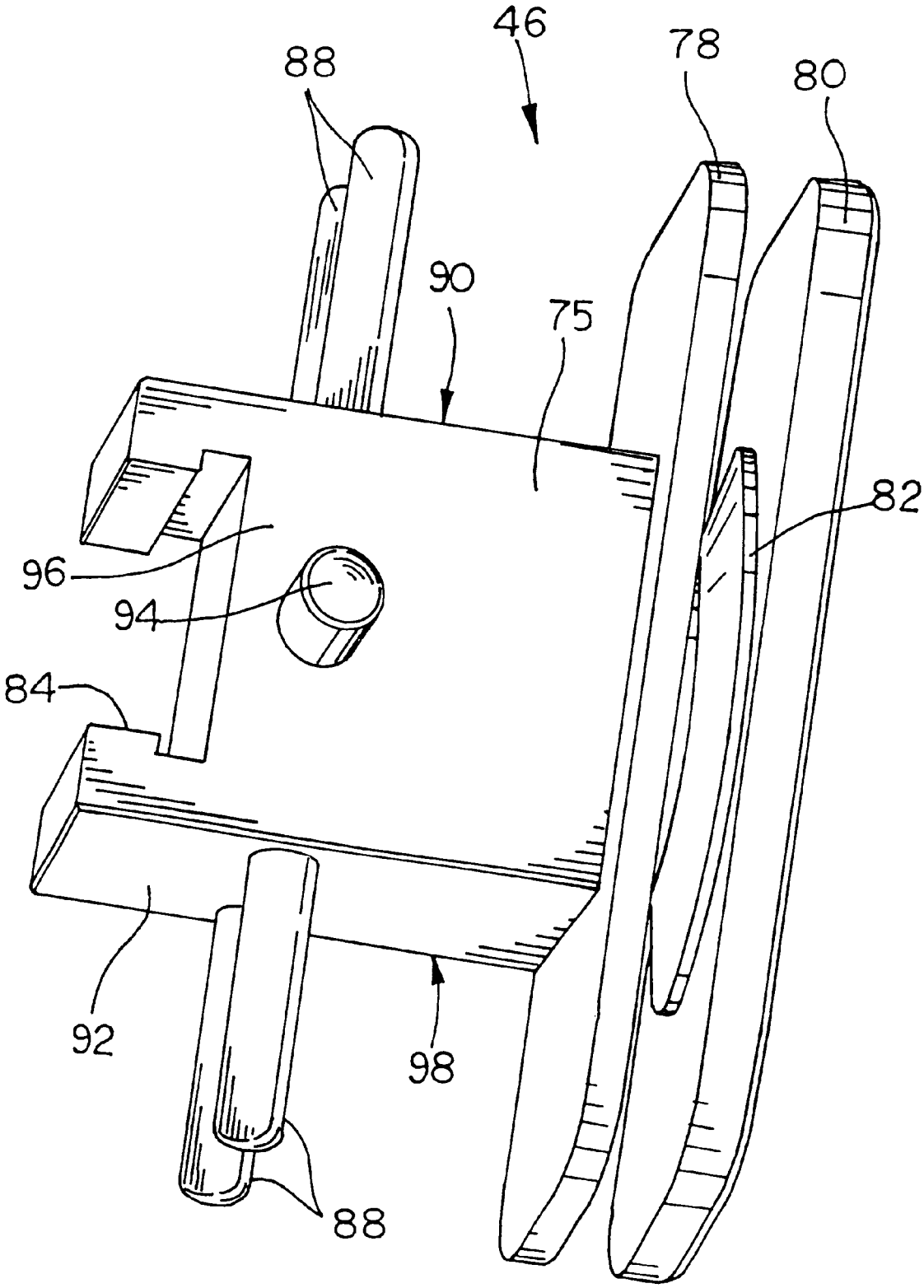
FIG. 11 is a perspective view of a spool in accordance with a preferred embodiment of the present invention.

Referring particularly to FIG. 11, spool 46 includes a hub 75, a first piston plate 78 and a second piston plate 80, each secured to the hub 75, and each being spaced from one another by an offset portion 82 formed on the second piston plate 80. Hub 75 is formed to include a "T" shaped slot 84 into which the flanges 76 are received for engaging the ejector plate assembly 66 with the spool 46.

The spool 46 is housed within the shank 26, and in accordance with the invention, remains within the shank 26 during the changing of a die assembly 30. As the die assembly 30 is separated from the shank 26, by sliding it from the shank 26 during a change of the die assembly 30, the ejector plate assembly 66 disengages from the spool 46, i.e., the flanges 76 disengage from the slot 84.

During operation of the die casting machine 10, the spool 46 remains stationary within the shank 26 relative to the die casting machine 10 during displacement of the shank 26, i.e., during closing and opening of the die assemblies 30. A cam (not shown) extends from the die casting machine 10 and through a slot 86 formed in the shank 26 (FIGS. 2 and 3) engaging the spool 46 between the first and second piston plates 78 and 80.

The first and second piston plates 78 and 80 are sized to be slidingly received within the chamber 44 of the shank 26. In a preferred embodiment, two pins 88 extend outwardly, in opposing direction, from the top side 90 and bottom side 92 the hub 75 and a single pin 94 extends outwardly, in opposing directions, from the front side 96 and the back side 98 of the hub 75. While six pins are described, one will appreciate that fewer or more pins may be used for this purpose.

In accordance with the invention, a plurality of die assemblies, each adapted for the production of different part or parts, may be constructed. Each die assembly in accordance with the invention includes a die member, adaptor plate and an ejector plate assembly. The die assemblies may be further adapted for the connection of cooling lines, production automation, and the like. The die assemblies may be quickly and easily changed by first disconnecting any attached cooling lines, production automation or the like. Next, the cam plates are removed freeing the die assemblies from their associated shanks. Replacement die assemblies may then be secured to the shanks. In doing so, the spools are engaged with the respective ejector plate assembly, and the die assemblies are secured using the cam plates. The accessory items, such as cooling lines, are reconnected and any final machine adjustments completed. Preferably, the die, adaptor plate and associated ejector plate assembly may be sized so as to provide a standardized die assembly so as to minimize adjustments to the die casting machine. That is, by providing substantially commonized die assemblies, adjustments to the die casting machine, such as die closing force, may be minimized.

The present invention has been described in terms of several preferred embodiments, each of which are intended to illustrate the principles of the present invention. One of ordinary skill in the art will appreciate that invention may be otherwise embodied without departing from the scope and spirit of the invention set forth in the subjoined claims.

We claim:

1. An apparatus comprising:

a shank including a front face, a rear face, a top portion, and a bottom portion defining a cavity and adapted to be coupled to a die casting machine, a spool disposed within the cavity, a die assembly comprising:

a die, an adaptor plate disposed within the cavity, secured to the die and coupled to the shank, an ejector plate disposed within the cavity for engaging the spool and for engaging a pair of ejector pins extending into the die for removing a die cast after formation, and a locking cam coupled to the shank for retaining the die assembly to the shank.

2. The apparatus of claim 1, wherein the shank includes at least one channel to secure the adaptor plate.

3. The apparatus of claim 1, wherein the adaptor plate includes at least one flange to slidably engage at least one channel of the shank to secure the die and the shank.

4. The apparatus of claim 1, wherein the shank includes a first and second channel that engages an adaptor plate formed to include a first and second flange respectively.

5. The apparatus of claim 1, wherein the ejector plate includes at least one flange that engages at least one complimentary channel formed within the spool.

6. The apparatus of claim 1, wherein the ejector plate includes a T-shaped flange that engages at least one complimentary channel formed within the spool.

7. The apparatus of claim 1, wherein the spool is slidably disposed within the cavity.

8. The apparatus of claim 1, wherein the s pool includes pin stabilizers to position the spool within the cavity.

9. A die casting machine comprising:

a machine base coupled to a toggle assembly, a shank including a front face, a rear face, a top portion, and a bottom portion defining a cavity and coupled to the toggle assembly, a spool disposed within the cavity, a die assembly comprising:

a die, an adaptor plate disposed within the cavity, secured to the die and coupled to the shank, an ejector plate disposed within the cavity for engaging the spool and for engaging a pair of ejector pins extending into the die for removing a die cast after formation, and a locking cam coupled to the shank for retaining the die assembly to the shank.

10. An apparatus comprising:

a shank including a front face, a rear face, a top portion, a bottom portion, and a side portion defining a cavity with an opening, adapted to be coupled to a die casting machine on the side portion with a toggle assembly, and including at least one channel to secure the adaptor plate, a spool slidably disposed within the cavity including a channel and including pin stabilizers to position the spool within the cavity, a die assembly comprising:

a die disposed adjacent the cavity opening, an adaptor plate disposed within the cavity, including at least one flange to slidably engage at least one complimentary channel of the shank and to secure the die, an ejector plate disposed within the cavity including a plurality of ejector pins for extending into the die for removing a die cast after formation, and including a T-shaped flange for engaging the complimentary shaped channel within the spool, and a locking cam coupled to the shank adjacent the die for retaining the die assembly to the shank.

* * * * *

UNITED STATES PATENT AND TRADEMARK OFFICE

CERTIFICATE OF CORRECTION

PATENT NO. : 6,422,297 B2
DATED : July 23, 2002
INVENTOR(S) : Zoltan P. Salata

It is certified that error appears in the above-identified patent and that said Letters Patent is hereby corrected as shown below:

Column 4,
Line 40, please delete “a ejector plate” and insert -- an ejector plate --

Column 6,
Line 20, please delete “wherein the s pool” and insert -- wherein the spool --

Signed and Sealed this

Twenty-fifth Day of February, 2003

JAMES E. ROGAN
*Director of the United States Patent and Trademark Office*